US005660750A

United States Patent [19]

Kusaka

[11] Patent Number: 5,660,750

[45] Date of Patent: Aug. 26, 1997

[54] IMAGE HEATING APPARATUS WITH ELASTIC HEATER

[75] Inventor: Kensaku Kusaka, Kawasaki, Japan

[73] Assignee: Canon Kabushiki Kaisha, Tokyo, Japan

[21] Appl. No.: 391,034

[22] Filed: Feb. 21, 1995

[30] Foreign Application Priority Data

Feb. 21, 1994 [JP] Japan ..... 6-022612

[51] Int. Cl.[6] ..... G03G 15/20

[52] U.S. Cl. ..... 219/216; 219/528; 399/329

[58] Field of Search ..... 219/216, 543, 219/549, 528; 355/285, 289, 290; 399/328, 329

[56] References Cited

U.S. PATENT DOCUMENTS

| | | | |
|---|---|---|---|
| 3,619,556 | 11/1971 | Deibel et al. | 219/549 |
| 4,791,275 | 12/1988 | Lee et al. | 219/216 |
| 5,043,763 | 8/1991 | Koh et al. . | |
| 5,149,941 | 9/1992 | Hirabayashi et al. . | |
| 5,182,606 | 1/1993 | Yamamoto et al. . | |
| 5,262,834 | 11/1993 | Kusaka et al. . | |
| 5,267,005 | 11/1993 | Yamamoto et al. . | |
| 5,278,618 | 1/1994 | Mitani et al. | 219/216 |
| 5,343,280 | 8/1994 | Hirabayashi et al. . | |
| 5,386,281 | 1/1995 | Mitani etal. | 355/290 |
| 5,401,936 | 3/1995 | Kusaka et al. . | |
| 5,499,087 | 3/1996 | Hiraoka et al. | 219/216 |

FOREIGN PATENT DOCUMENTS

| | | | |
|---|---|---|---|
| 2014107 | 4/1970 | France | 219/216 |

*Primary Examiner*—Teresa J. Walberg
*Assistant Examiner*—Gregory L. Mills
*Attorney, Agent, or Firm*—Fitzpatrick, Cella, Harper & Scinto

[57] ABSTRACT

An image heating apparatus includes a heater, the heater including a base material and a heat generating element on the base material; a film contacting the heater at one surface carrying a toner image at the other surface; wherein the toner image on the recording material is heated by heat from the heater through the film, wherein the base material of the heater is of an elastic material.

11 Claims, 6 Drawing Sheets

IMAGE HEATING APPARATUS WITH ELASTIC HEATER

FIELD OF THE INVENTION AND RELATED ART

The present invention relates to an image heating device and a heater for heating an image on a recording material, and relates, more particularly to an image heating device and a heater suitable for a device for heating and fixing an unfixed image on a recording material usable with a copying machine and a laser beam printer or the like.

Heretofore, as for the image heating device for heating and fixing an unfixed image and/or for executing improvement of a surface property of the image, a heat roller type wherein the recording material supporting the image is nipped and transported by a heating roller and a pressing roller has been widely used. However, with such a heat roller type, a heat capacity of the heating roller is large, and therefore, the time (so-called warm up time) required to heat the heat roller up to a predetermined fixing temperature, is long.

U.S. Pat. No. 5,149,941 (Japanese Laid Open Patent Application No. SHO- 63-313182), U.S. Pat. No. 5,262,834 (Japanese Laid Open Patent Application No. HEI-2-157878) or the like, has proposed a film heating and fixing device which uses a small thickness film sliding relative to a thermal head functioning as a heater of a low heat capacity so that the warm up time is reduced.

However, when the use is made with the above-described film heating type, there is a liability that the following problem arises. The developers deposited on the recording material are isolated with each other, in some cases. This frequently occurs when a half-tone image is formed on the recording material using the electrophotographic type image forming apparatus using a laser, a diode and/or LED or the like, for example, and using system in which the digital image is written on the photosensitive member wherein an image occupying area in one pixel can be modulated. However, in the case that such an isolated developer is heated using the above-described film heating type, if the heater is a rigid member urged to the developer through the film, the area of the developer contacting the heater through the film therebetween is small, and the heat transfer efficiency is low. As a result, the fixing property of the half-tone image having many isolated toners is worsened.

In addition, in the case that thick paper such as Japanese government-printed post card is heated as the recording material, if the heater is the rigid member, a gap is produced between the pressing roller and the heater at the non-sheet passing or processing area at the lateral end portion of the recording material. Then, the heat radiation from the heater is small at the portion with the result that temperature rises abnormally at the portion of the heater, and there is a liability that damage of the heating member per se and/or damage of the member such as the film in contact with the heater is brought about.

SUMMARY OF THE INVENTION

An object of the present invention is to provide an image heating device and a heater having an increased heat transfer efficiency relative to toner.

Another object of the present invention is to provide and image heating device and a heater wherein the damage of a heater and a film or the like is prevented even if the recording material is relatively thick. A further object of the present invention is to provide an image heating device and a heater comprising a heater base material of an elastic material.

A further object of the present invention is to provide an image heating device and a heater comprising a heat generating element of an elastic material on a base material of a heater. A further object of the present invention is to provide an image heating device and a heater comprising an elastic electrode member extended along a heat generating element in order to energize the heat generating element of the heater.

A further object of the present invention is to provide an image heating device wherein a press-contact portion of the heater with a back-up member is capable of elastic deformation.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Referring to FIGS. 1–7, an embodiment of the present invention will be described.

Figure 1:
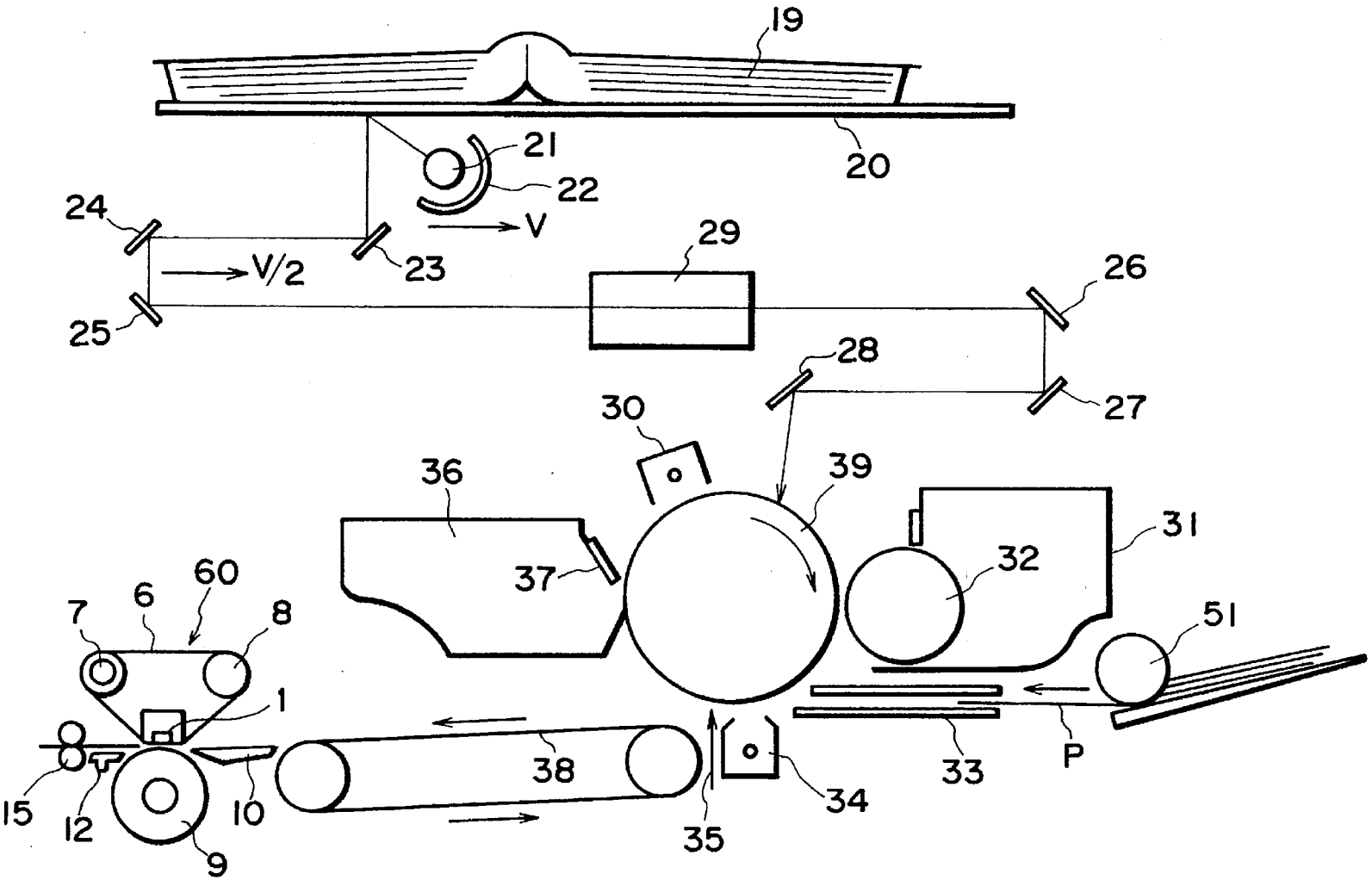
FIG. 1 is a sectional view of an image forming apparatus using an image heating device according to an embodiment of the present invention.

FIG. 1 is a schematic sectional view of an image forming apparatus using an image heating device according to an embodiment of the present invention, and it is an electrophotographic coping apparatus of an original carriage fixed type, an optical system movement type, a rotatable drum type and an image transfer type. In the apparatus of this embodiment, as shown in FIG. 1 an original 19 is placed in a predetermined manner on a fixed original carriage glass 20, and the predetermined copying conditions are set, and thereafter the copy start key is depressed.

Then, a photosensitive member drum 39 is rotated at a predetermined peripheral speed in the clockwise direction indicated by an arrow. A light source 21 (22 is a reflection shade) and a first mirror 23 move at a predetermined speed of V to right-hand side of the glass from the home position of left-hand side of the glass along the bottom side of an original carriage glass 20, and a second mirror 24 and a third mirror 25 move at the speed of V/2 in the same direction.

By this, a faced-down image surface of the placed original 19 on the original carriage glass 20 is illuminated and scanned to the right-hand side from the left-hand side, and the light reflected by the surface of the original is projected and imaged (slit exposure) on the surface of the rotating photosensitive member drum 39 through fixed fourth–sixth mirrors 26, 27, 28 and an imaging lens 29.

The surface of the photosensitive member drum 39 has been uniformly charged to a primary charger 30 before the exposure, and the above-described exposure is effected to the charged surface so that an electrostatic latent image of a pattern corresponding to the original image is formed sequentially on the surface of the drum 39. The electrostatic latent image formed on the surface of the photosensitive member drum 39 is visualized into a toner image by a developing roller 32 of a developing device 31.

On the other hand, a recording material P is fed by the sheet feeding roller 51, and is introduced to a transfer portion between a transfer charger 34 and the drum 39 at a predetermined timing through a guide 33 to be contacted to the drum 39 at the position for receiving transfer corona so that the toner visualized image on the surface of the drum 39 is transferred sequentially onto the recording material surface.

The recording material P having passed the image transfer portion received the discharging of the back surface charge by a discharging needles 35 while being separated sequentially from the surface of the drum 39, and is introduced to the fixing device 60 through a transportation portion 38, an inlet guide 10, and thereafter, as will be described hereinafter, is subjected to the toner image fixing operation, and it is discharged to outside of the machine as a print.

As to the surface of the drum 39 after the transfer, a contamination such as the residual toner is removed by a cleaning blade 37 of a cleaner 36, and is repeatedly subjected to the image forming operation. When the movable optical members 21–25 move through the forward passage, as described hereinbefore it reaches the end portion of the predetermined forward passage, and it moves backwardly to the home portion, and awaits the next copy cycle.

Figure 2:
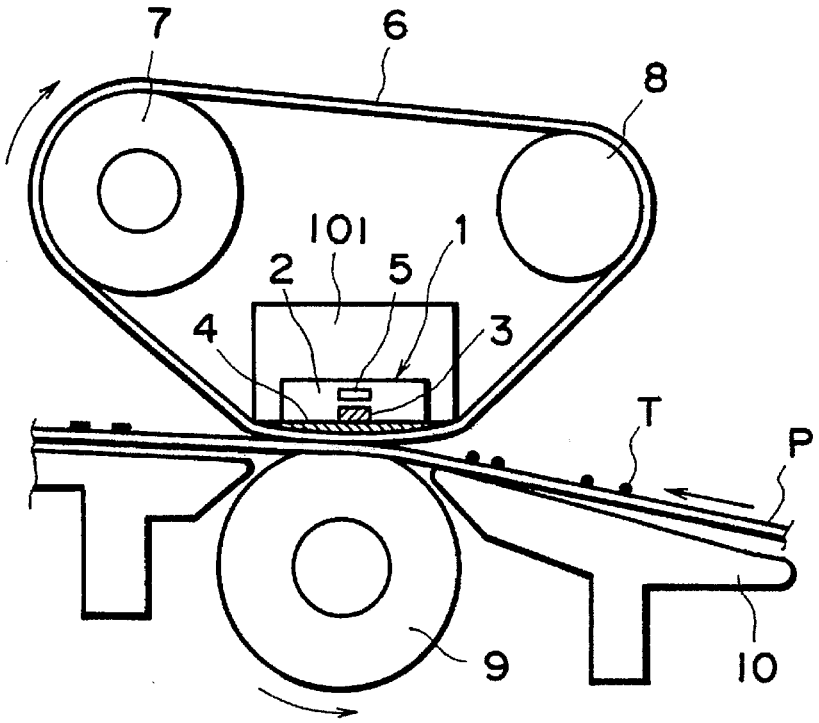
FIG. 2 shows an image heating device of FIG. 1.

Referring to FIG. 2 the fixing device 60 mounted to the apparatus of this embodiment will be described in detail. In FIG. 2, a liner heater 1 of a low heat capacity is of is fixed to the fixing device 60, by a holder 101 comprising, PPS, a liquid crystal polyester PEEK or another heat resistive resin material.

The heater 1 comprises a heat resistive elastic plant of a material 2 such as a fluorine rubber or a silicone rubber having a JIS A hardness of 20°–90°, a length of 240 mm (perpendicular to sheet of the drawing), a width of 10 mm, and a thickness of 1.0 mm, for example, a resistance sheet 3 in the form of a heat generating element comprising a resistance material such as nickel/chrome alloy having a width of 2.0 mm, a thickness of 20 microns, bonded thereon by a silicone adhesive material or the like, and a PFA coating layer 4 having a thickness of 10 microns for improvement of the sliding property with the film 6 on the surface.

The resistance sheet 3 is energized from the longitudinal opposite ends. The energization is controlled by a control means (not shown) including a micro computer, so that the temperature detected by the temperature sensing element 5 such as a thermistor, small NTC (a negative resistance temperature coefficient) disposed adjacent to or in contact with the above-described resistance sheet 3 is kept at a predetermined constant temperature. A thin film 6 is of a thickness of 40 microns approx. and is of polymide coated with fluorine resin material thereon, and is extended around a driving roller 7, a follow roller 8 and the heater 1.

A pressing roller 9 is a back-up member press-contacted to the heater 1 through film 6 therebetween, and the recording material carrying the unfixed toner image is nipped and transported at the press-contact portion so that the unfixed toner image is heated and fixed on the recording material.

When 200 sheets of the thick paper of a thickness of 250 microns are processed continuously, using the fixing device 60, the proper fixing property property is provided, and there has not been any abnormality in the device.

One the other hand, in the case of a comparison example using an alumina base plate of the same dimension in place of the elastic plate 2 of the embodiment, the proper fixing property is provided for the solid image having an image density not less than 1.0, but the fixing property for so-called half-tone image of approximately 0.5 was not so preferable.

With respect to the fixing property of the half-tone image, the description will be made as to, as to the reason of the difference between the comparison example and embodiment, referring to FIGS. 4 and 5.

Figure 4:
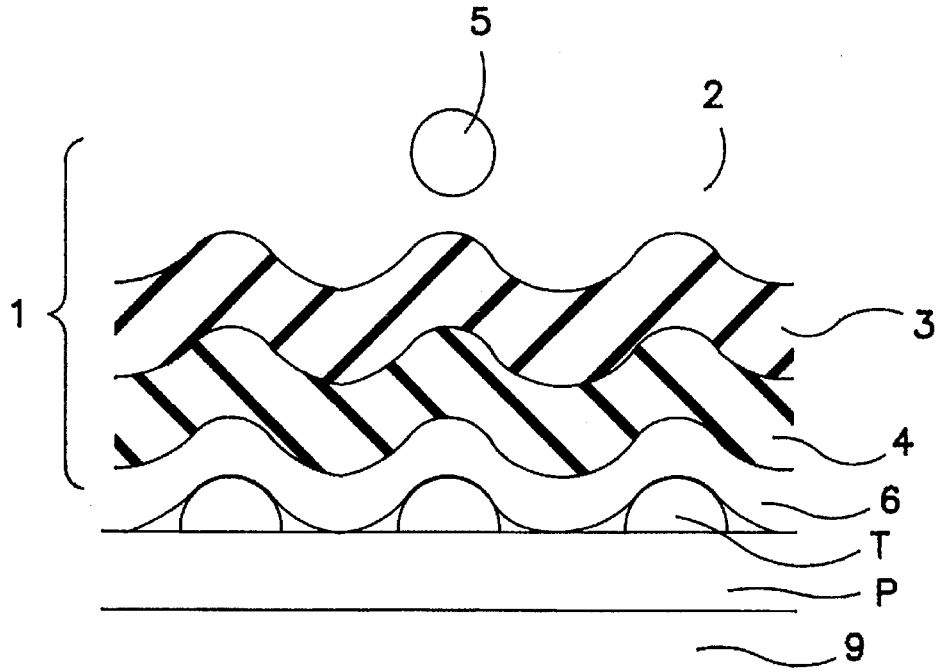
FIG. 4 is a schematic view showing a press-contact portion between a pressing roller and a heater in an embodiment.

FIG. 4 shows an embodiment, and is a schematic view of the section, in the direction perpendicular to the recording material transportation direction (longitudinal direction of the heater), of the press-contact portion between the pressing roller and the heater, during fixing process for the half-tone image.

The heater 1 elastically deforms so as to be along the toner T to a certain degree (the coating layer 4 and the resistance sheet 3 are sufficiently thin, and follow sufficiently to the deformation of the elastic plate 2). Therefore, the gap between the heater and the toner decreases so that the heat transfer is improved, and therefore, the toner is sufficiently fused, and as a result, it is fixed satisfactorily to the recording member.

Figure 5:
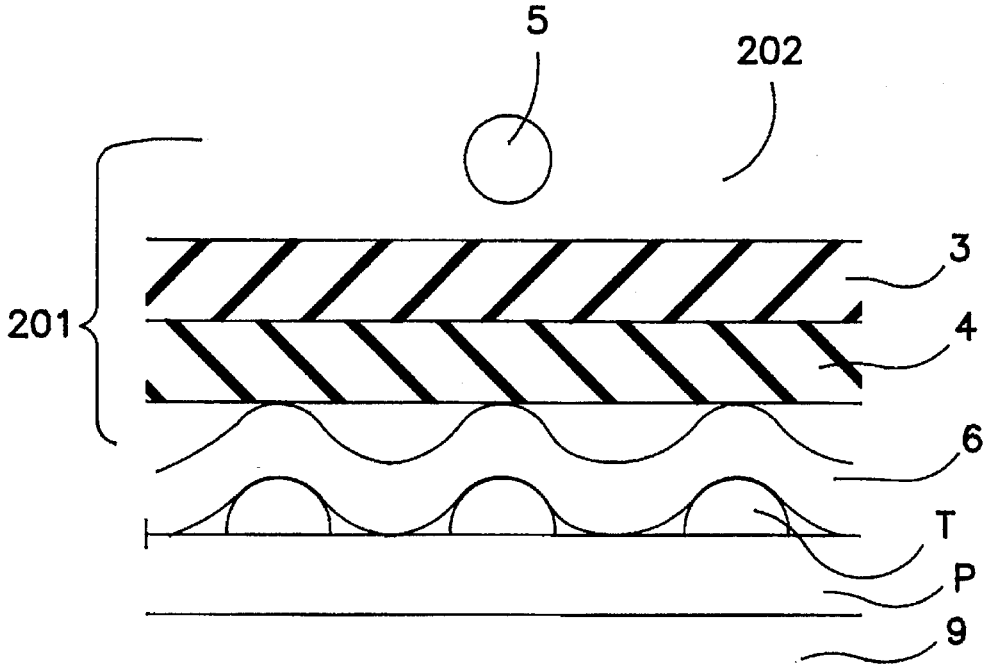
FIG. 5 is a schematic view showing a press-contact portion between a pressing roller and a heater in a comparison example.

FIG. 5 shows a comparison example with respect to FIG. 4. The heater 201 provided with the alumina base plate 202 is rigid, and therefore, the thermal resistance between the toner T is large. And therefore, the heating of the toner is not enough with the result that the proper fixing property is not provided. In addition, with the comparison example, 200 sheets of the thick paper of a thickness of 250 microns have been subjected to continuous fixing process. Then, creases are produced in a part of of the film 6 (the region up to approx. 5 mm of the opposite ends from the paper end portion of the thickness paper sheet processing area).

Figure 6:
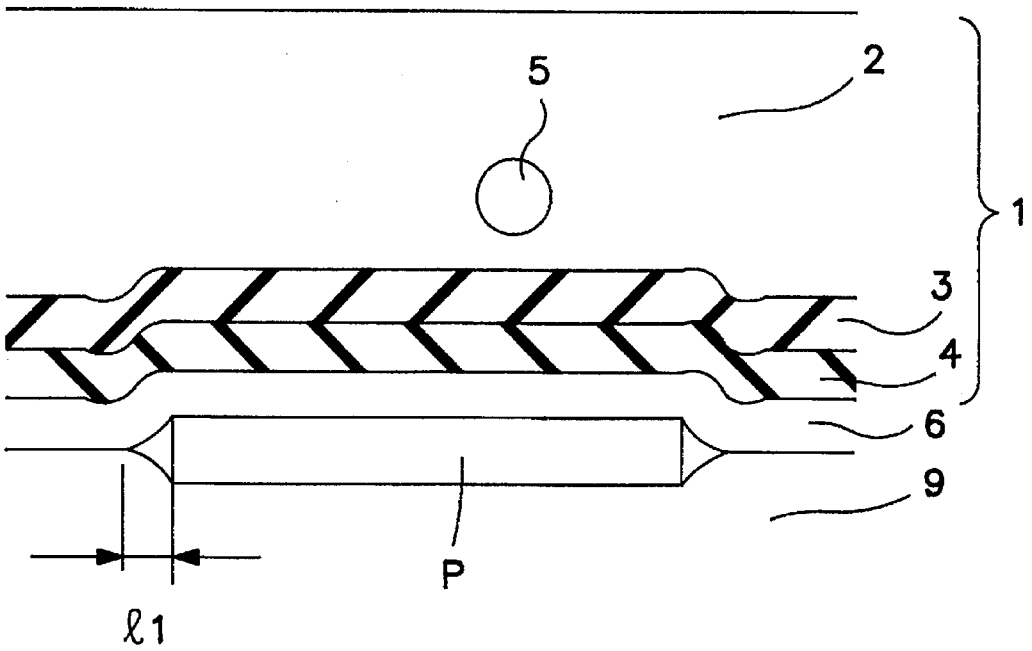
FIG. 6 is a schematic view showing a press-contact portion between a pressing roller and a heater in the thick paper sheet processing in an embodiment.
Figure 7:
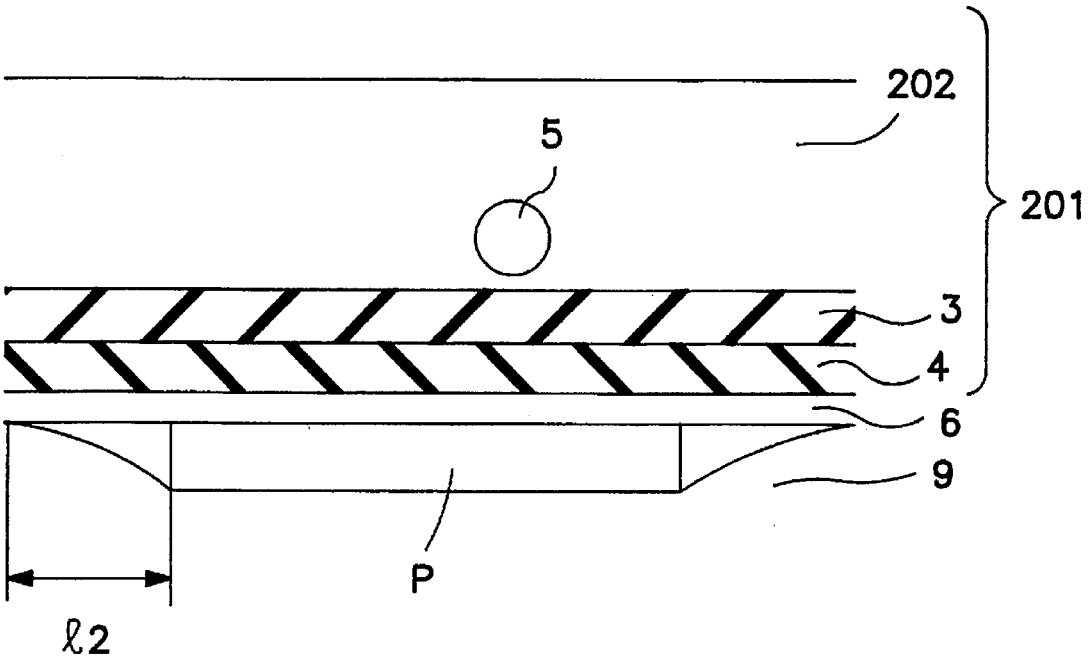
FIG. 7 is the schematic view showing a press-contact portion between a pressing roller and a heater in a thick paper sheet processing in a comparison example.

The description will be made as to the reason for the occurrence of the creases in the film 6 in the comparison example, despite the fact that there is not a damage in the device according to the embodiment during the thick paper sheet processing. FIG. 7 and FIG. 6 show an embodiment and a comparison example, respectively. They are schematic view of the sections, perpendicular to the direction of the recording material transportation, of the press-contact portion between the pressing roller and the heater, when the thick paper is subjected to the fixing process.

Reference numerals, 11, 12 show widths of the gaps in the recording material end portions in the comparison example and the embodiment, respectively. In the portion having the gap, the heat radiation is small from the heater as compared with another portion. Temperature detected by the temperature sensing element 5 is controlled so as to be constant, and therefore, the temperature of the heater corresponding to the gap portion, is more high than the heater temperature of the portion where the recording material passes, and additionally, the heater temperature increases with increase of the width of the gap portion.

In the embodiment, the heater 1 deforms so as to be along the recording material, and therefore, 11 is small.

On the other hand, in the comparison example, the heater 201 is not along the recording material, and therefore, 12 is larger.

As a result, in the comparison example the surface temperature of the heater in the region of 12, rises, and the film in contact with the heater overheats, resulting in thermal deformation in some cases. In this manner, in this embodiment, the base plate is of an elastic plate, and the press-contact portion of the heater is capable of the elastic deformation, and therefore the close-contactness between the heater and the toner is increased, an the heat transfer efficiency can be improved thereby.

In this embodiment, the description has been made as to the example of the half-tone image, and also as to the image of the normal densities, the heat transfer efficiency can be increased. Use of the image heating device of this embodiment for a color image in the form of laminated various color toners is very effective from the standpoint of increasing the fixing property. In addition, in this embodiment, the gap between the pressing roller and the film outside the recording material end portion can be reduced so that the damage due to the heat of the heater by itself and the film can be prevented.

In addition, when the film 6 of this embodiment comprises a polymide of a thickness of 12.5 microns, and PFA of a thickness of 5 microns coated on the image contact surface thereof and having a total thickness 17.5 microns (generally, it is preferable that the total thickness of the film is 10–25 microns), the adhesiveness to the toner on the recording material, is further proper so that the half-tone fixing property is further improved.

Figure 3:
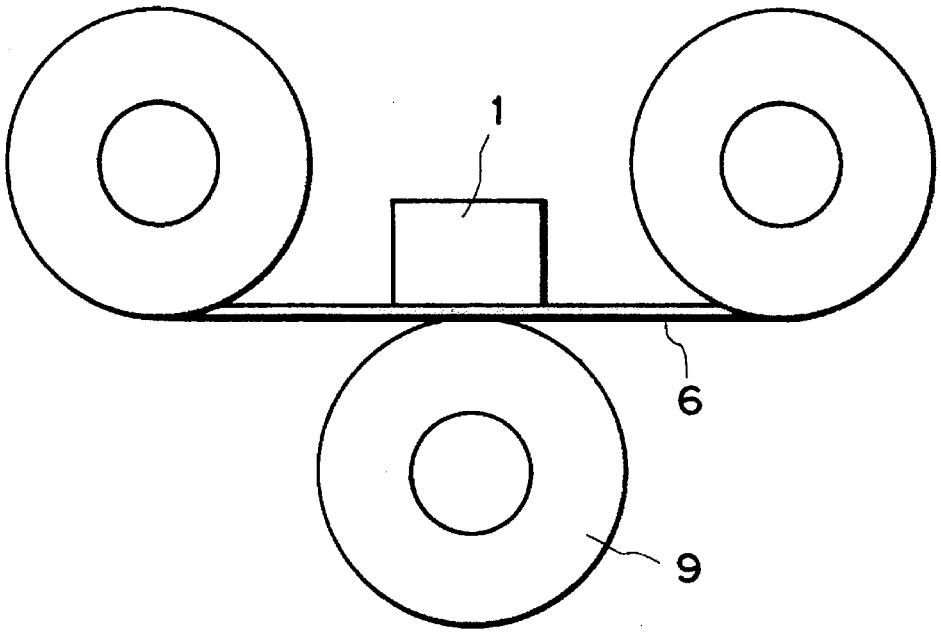
FIG. 3 shows an image heating device using the non-endless film.

The endless film of the fixing device used in the embodiment of the present invention can be a non-endless film 6 as FIG. 3.

Figure 8:
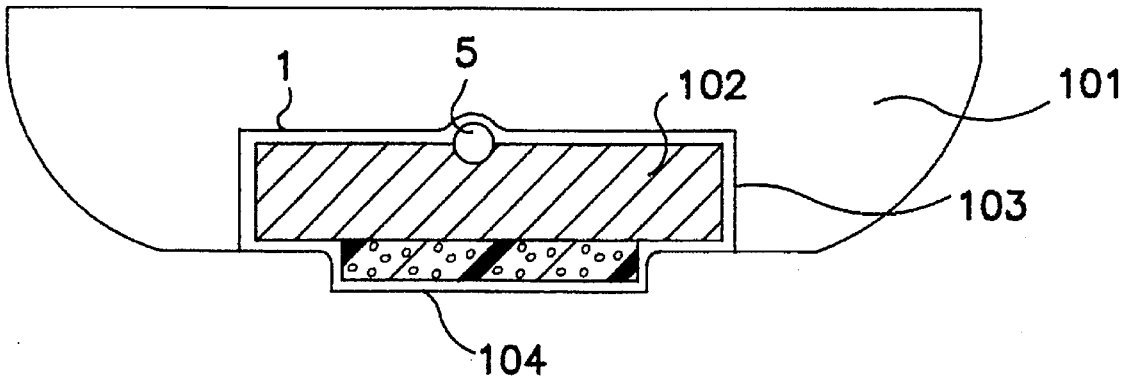
FIG. 8 is a sectional view of a heater according to another embodiment of the present invention.
Figure 9:
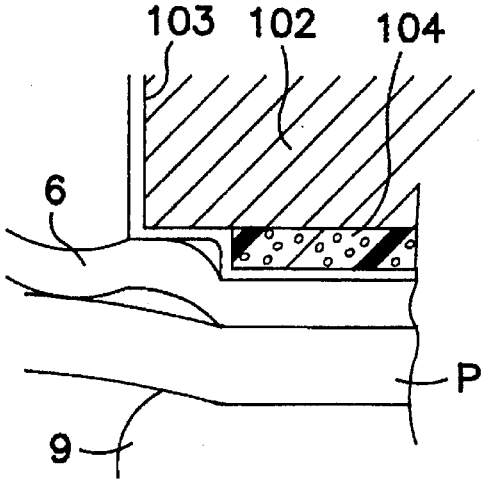
FIG. 9 is a partially enlarged view of a heater FIG. 8.

Referring to FIG. 8 and FIG. 9, another embodiment of the present invention will be described.

As shown in FIG. 8, in this embodiment, it comprises an alumina base plate 102 having a length of 240 mm, a width of 10 mm and a thickness of 0.635 mm, and an electroconductive silicone rubber sheet 104 having a width of 3 mm and a thickness of 0.3 mm on the surface thereof bonded thereto through a primer. Into a back side of the alumina base plate 102, a temperature sensing element 5 comprising a small NTC thermistor is embedded.

The circumferences of the alumina base plate 102, the electroconductive silicone rubber sheet 104 and the temperature sensing element 5 are wound by, a seamless PFA tube 103 of a thickness of 20 microns. The electroconductive silicone rubber sheet is energized from the opposite ends in the longitudinal direction (perpendicular to sheet of the drawing), and the temperature thereof is controlled using the temperature sensing element 5.

In this manner, also by this embodiment, the press-contact portion of the heater can be elastically deformed so that the effect which is similar to the above described can be provided. In addition, by this embodiment, a further peculiar effect is provided.

The resistance member in the form of the electroconductive silicone rubber sheet per se is an elastic member, and the alumina base plate supporting it is a rigid member, and therefore there is not the mechanical fatigue by the bending of the heat-generating resister, so that the durability of the device is high. Still, the proper fixing property for the half-tone image is provided.

In addition, the convex-down configuration can be realized easily by the use of the electroconductive silicone rubber sheet. The downstream side, with respect to the sheet facing direction, of the convex configuration is at least inside of the press-contact portion with the pressing roller by which as in FIG. 9 the faced-up curl can be made easily in the recording material P.

Figure 10:
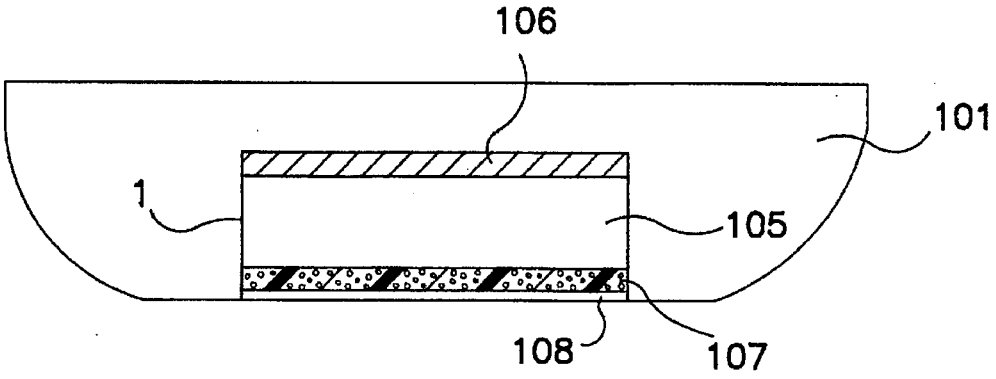
FIG. 10 is a sectional view of a heater according to a further embodiment of the present invention.
Figure 11:
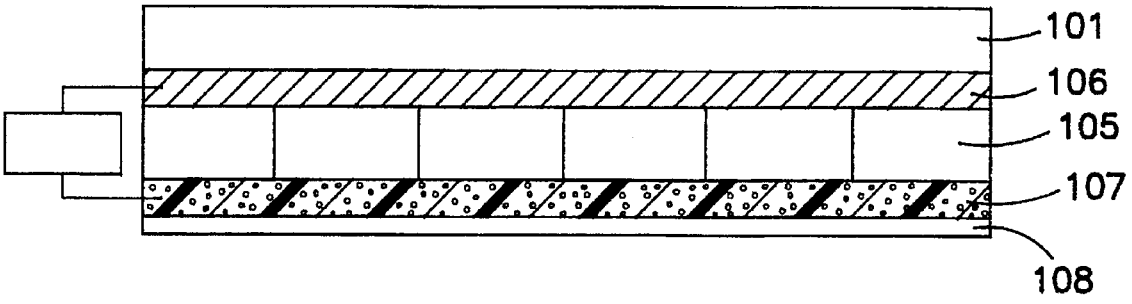
FIG. 11 is a sectional view, in the longitudinal direction, of the heater of FIG. 10.

Referring to FIG. 10 and FIG. 11, a further embodiment of the present invention will be described. As shown in the Figure, in this embodiment, it comprises PTC juxtaposed chips 105 having a positive resistance/temperature coefficient of the barium titanate or the like having a length of 20 mm, a width of 10 mm and a thickness of 1 mm sandwiched between an aluminum plate 106 having a length of 240 mm, a width of 10 mm and a thickness of 1 mm and an electroconductive silicone rubber 107 having a length of 240 mm, a width of 10 mm and a thickness of 0.5 mm.

The surface of the electroconductive silicone rubber 107 is coated with a PTFE layer 108 having a thickness of 10 microns. The energization is effected between the electroconductive silicone rubber 107 and the aluminum plate 106 as the electrode member. In this manner, in this embodiment, the electroconductive silicone rubber as the electrode member is provided along the heat generating element having a plurality of the juxtaposed PTC chips, and therefore the elastic deformation of the heating member press-contact portion, can be permitted, and therefore, effects which are similar to the above-described can be provided.

In addition, the PTC chip is used for the temperature control using the property of abrupt rising of the resistance value above the predetermined temperature, but, as the case may be, the temperature may be controlled using an unshown temperature sensing element. According to this embodiment, the PTC chip does not rise above the predetermined temperature, and therefore, even if the thick paper is processed, the heater temperature at the end portion of the sheet passage does not rise.

Accordingly, the thermal damage of the film, does not occur, and therefore, the temperature of the heater of the recording material passing region can be increased sufficiently, so that the half-tone fixing property is further improved. In addition, in the case that the hardness of the electroconductive silicone rubber 107 is lowered (JIS A, 20°–40°), a thin copper plate may be interposed between the PTC chip 105, and the electric connection may be accomplished through the copper plate. In such a case, the rubber may be non-electroconductive. In addition, the exposure of the photosensitive member drum 39 in the above-described embodiment may be carry out by a laser, a diode, LED or the like. In such a case, the resolution of the exposure is 600 dpi, for example, and the tone gradient number per pixel is 256. In the case of a laser diode, the area of the latent image formed on the photosensitive member drum 39 is changeable depending on the laser emission time. In such a case, the toner on the recording material P is easily isolated one another, but when the present invention is applied in the device of this kind, the fixing property of the half-tone image is improved. For this reason, it can be said that the present invention is parly suitable to a digital type image forming apparatus.

While the invention has been described with reference to the structure disclosed herein, it is not confined to the details set forth and this application is intended to cover such modifications of changes as may come within the purposes of the improvements or the scope of the following claims.

What is claimed is:

1. An image heating apparatus comprising:

a heater which is stationary in use;

said heater including a base plate; a heat generating element directly on said base plate; and a coating layer directly on said base plate and said heat generating element; and a film having a surface slidable in contact with the coating layer of said heater, and another surface movable with a recording material in contact with a toner image thereon, wherein the toner image on the recording material is heated by heat from said heater through said film; and wherein said base plate is of rubber material.

2. An apparatus according to claim 1, wherein said rubber has a hardness of 20–90 degrees (JIS-A).

3. An apparatus according to claim 1, wherein said rubber material is selected from the group consisting of silicone and fluorine rubber.

4. An apparatus according to claim 1, wherein said heat generating element has a resister sheet.

5. An apparatus according to claim 1, wherein said heat generating element measured in a movement direction of the recording material, has a width which is smaller than that of said base plate.

6. An apparatus according to claim 1, wherein said heat generating element is bonded directly on said base plate by a bonding material.

7. An apparatus according to claim 1, wherein said heat generating element and said coating layer are thin layers.

8. An apparatus according to claim 7, wherein said heat generating element and said coating layer has a combined thickness of about $10^{-2}$ mm.

9. An apparatus according to claim 1, wherein the toner image which is not fixed is fixed on the recording material by the heat through said film.

10. An apparatus according to claim 9, wherein the unfixed toner images includes layers of different color toner materials, which are mixed and fixed on the recording material by the heat.

11. An apparatus according to claim 1, further comprising a pressing member for cooperating with said heater to form a nip therebetween with said film therebetween, wherein the recording material carrying the toner image is fed by said nip.

* * * * *

UNITED STATES PATENT AND TRADEMARK OFFICE

CERTIFICATE OF CORRECTION

PATENT NO. : 5,660,750
DATED : August 26, 1997
INVENTOR(S) : Kensaku KUSAKA

It is certified that error appears in the above-identified patent and that said Letters Patent is hereby corrected as shown below:

Title Page, [57] (Abstract):
Line 3, after "surface", insert --thereof and contactable to a recording material--.

Column 1:
Line 37, after "using", insert --a--;
Line 64, delete "and" and insert therefor --an--.

Column 2:
Line 58, delete "coping" and insert therefor --copying--.

Column 3:
Line 2, after "to", insert --the--;
Line 3, after "of" (first occurrence), insert --the--;
Line 31, delete "received" and insert therefor --receives--;
Line 32, delete "needles" and insert therefor --needle--;
Line 49, delete "of is".

UNITED STATES PATENT AND TRADEMARK OFFICE

CERTIFICATE OF CORRECTION

PATENT NO. : 5,660,750
DATED : August 26, 1997
INVENTOR(S) : Kensaku KUSAKA

It is certified that error appears in the above-identified patent and that said Letters Patent is hereby corrected as shown below:

Column 4:

Line 15, delete "property" (first occurrence);
Line 16, delete "has not been any" and insert therefor --is no--;
Line 24, delete "as to,";
Line 25, delete "and" and insert therefor --an--;
Line 48, after "to", insert --a--;
Line 55, delete "not a" and insert therefor --no--;
Line 59, delete "view" and insert therefor --views--.

Column 5:

Line 3, delete "more high" and insert therefor --higher--;
Line 19, delete "an" and insert therefor --and--.

Column 6:

Line 56, delete "carry" and insert therefor --carried--;
Line 66, delete "parly" and insert therefor --particularly--;

UNITED STATES PATENT AND TRADEMARK OFFICE

CERTIFICATE OF CORRECTION

PATENT NO. : 5,660,750
DATED : August 26, 1997
INVENTOR(S) : Kensaku Kusaka

It is certified that error appears in the above-identified patent and that said Letters Patent is hereby corrected as shown below:

Column 8:

Line 11, delete "has" and insert therefor --have--.

Signed and Sealed this

Seventh Day of April, 1998

Bruce Lehman

*Attest:*

BRUCE LEHMAN

*Attesting Officer*

*Commissioner of Patents and Trademarks*